US006726300B2

(12) United States Patent
Schloeman et al.

(10) Patent No.: US 6,726,300 B2
(45) Date of Patent: Apr. 27, 2004

(54) FIRE PULSES IN A FLUID EJECTION DEVICE

(75) Inventors: Dennis J. Schloeman, Corvallis, OR (US); James A. Feinn, San Diego, CA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 10/134,124

(22) Filed: Apr. 29, 2002

(65) Prior Publication Data

US 2003/0202025 A1 Oct. 30, 2003

(51) Int. Cl.[7] ..... B41J 29/38

(52) U.S. Cl. ..... 347/12; 347/9; 347/180; 347/211

(58) Field of Search ..... 347/9, 12, 13, 347/42, 180, 211

(56) References Cited

U.S. PATENT DOCUMENTS

| | | | |
|---|---|---|---|
| 4,437,752 A | 3/1984 | Akashi et al. | |
| 4,463,359 A | 7/1984 | Ayata et al. | 346/1.1 |
| 4,595,935 A | 6/1986 | Brooks et al. | 346/76 PH |
| 4,596,995 A | 6/1986 | Yamakawa et al. | |
| 4,695,853 A | 9/1987 | Hackleman et al. | 346/140 R |
| 4,695,854 A | 9/1987 | Cruz-Uribe | 346/140 R |
| 4,719,477 A | 1/1988 | Hess | 346/140 R |
| 4,764,659 A | 8/1988 | Minami et al. | 219/216 |
| 4,982,199 A | 1/1991 | Dunn | 346/1.1 |
| 4,989,224 A | 1/1991 | Narahara et al. | |
| 4,999,650 A | 3/1991 | Braun | 346/140 R |
| 5,016,023 A | 5/1991 | Chan et al. | 346/1.1 |
| 5,030,971 A | 7/1991 | Drake et al. | 346/140 R |
| 5,049,898 A | 9/1991 | Arthur et al. | 346/1.1 |
| 5,057,854 A | 10/1991 | Pond et al. | |
| 5,079,189 A | 1/1992 | Drake et al. | |
| 5,098,503 A | 3/1992 | Drake | |
| 5,103,246 A | 4/1992 | Dunn | 346/140 R |
| 5,160,945 A | 11/1992 | Drake | |
| 5,327,165 A | 7/1994 | Elliott | 346/76 PH |
| 5,363,134 A | 11/1994 | Barbehenn et al. | 347/49 |
| 5,365,312 A | 11/1994 | Hillmann et al. | 355/206 |
| 5,371,530 A | 12/1994 | Hawkins et al. | 347/9 |
| 5,541,629 A | 7/1996 | Saunders et al. | 347/12 |
| 5,604,513 A | 2/1997 | Takahashi et al. | 345/153 |
| 5,610,635 A | 3/1997 | Murray et al. | 347/7 |
| 5,646,660 A | 7/1997 | Murray | 347/59 |
| 5,648,804 A | 7/1997 | Keefe et al. | 347/47 |
| 5,684,518 A | 11/1997 | Nobel et al. | |
| 5,696,544 A | 12/1997 | Komuro | |

(List continued on next page.)

FOREIGN PATENT DOCUMENTS

| | | | |
|---|---|---|---|
| EP | 0547921 B1 | 6/1993 | B41J/2/175 |
| EP | 1029674 A2 | 8/2000 | |
| EP | 1031421 A1 | 8/2000 | |

OTHER PUBLICATIONS

A copy of European Search Report for Application No. EP 02 25 0006 mailed on Apr. 22, 2003 (3 pages).

(List continued on next page.)

*Primary Examiner*—Stephen Meier
*Assistant Examiner*—Lam Nguyen

(57) ABSTRACT

An fluid ejection device includes nozzles and includes firing resistors which correspond to the nozzles. Each firing resistor and corresponding nozzle are located in zones on the fluid ejection device where each zone has at least one firing resistor and corresponding nozzle. Addressable select logic responsive to a select address couples fire pulses to the firing resistors in the zones so that each firing resistor in each zone is coupled to the same fire pulse.

17 Claims, 10 Drawing Sheets

U.S. PATENT DOCUMENTS

| | | | | | |
|---|---|---|---|---|---|
| 5,719,605 | A | | 2/1998 | Anderson et al. | |
| 5,742,305 | A | | 4/1998 | Hackleman | |
| 5,751,302 | A | * | 5/1998 | Rezanka | 347/9 |
| 5,755,024 | A | | 5/1998 | Drake et al. | |
| 5,803,628 | A | | 9/1998 | Donahue | |
| 5,815,172 | A | | 9/1998 | Moh | 347/14 |
| 5,815,180 | A | | 9/1998 | Barbour et al. | 347/59 |
| 5,867,183 | A | | 2/1999 | Cornell et al. | |
| 5,886,718 | A | | 3/1999 | Johnson et al. | 347/85 |
| 5,946,012 | A | | 8/1999 | Courian et al. | 347/63 |
| 5,975,667 | A | | 11/1999 | Moriguchi et al. | |
| 6,002,420 | A | | 12/1999 | Tanioka et al. | |
| 6,091,891 | A | | 7/2000 | Overall et al. | 395/112 |
| 6,109,716 | A | | 8/2000 | Takahashi | 347/11 |
| 6,126,261 | A | | 10/2000 | Yamanaka | 347/12 |
| 6,178,009 | B1 | | 1/2001 | Yamada et al. | 358/1.9 |
| 6,193,345 | B1 | | 2/2001 | Feinn et al. | 347/12 |
| 6,290,333 | B1 | | 9/2001 | Wade et al. | |
| 6,318,847 | B1 | | 11/2001 | Wade | 347/62 |

OTHER PUBLICATIONS

Allen, Ross R., "Ink Jet Printing with Large Pagewide Arrays: Issues and Challenges," Recent Progress in Ink Jet Technologies ll, Chapter 2, pp. 114–120.

* cited by examiner

FIRE PULSES IN A FLUID EJECTION DEVICE

THE FIELD OF THE INVENTION

The present invention relates generally to fluid ejection devices, and more particularly to fire pulses in fluid ejection devices.

BACKGROUND OF THE INVENTION

A conventional inkjet printing system includes a printhead, an ink supply which supplies liquid ink to the printhead, and an electronic controller which controls the printhead. The printhead ejects ink drops through a plurality of orifices or nozzles and toward a print medium, such as a sheet of paper, so as to print onto the print medium. Typically, the orifices are arranged in one or more arrays such that properly sequenced ejection of ink from the orifices causes characters or other images to be printed upon the print medium as the printhead and the print medium are moved relative to each other.

Typically, the printhead ejects the ink drops through the nozzles by rapidly heating a small volume of ink located in vaporization chambers with small electric heaters, such as thin film resistors. Heating the ink causes the ink to vaporize and be ejected from the nozzles. To heat the ink, power is supplied to the thin film resistors. Power consumed by the thin film resistors is equal to Vi, where V is the voltage across the thin film resistor and i is the current through the thin film resistor. The electronic controller, which is typically located as part of the processing electronics of a printer, controls the power supplied to the thin film resistors from a power supply which is external to the printhead.

In one type of inkjet printing system, printheads receive fire signals containing fire pulses from the electronic controller. The electronic controller controls the drop generator energy of the printhead by controlling the fire signal timing. The timing related to the fire signal includes the width of the fire pulse and the point in time at which the fire pulse occurs. The electronic controller also controls the drop generator energy by controlling the electrical current passed through the thin film resistors by controlling the voltage level of the power supply.

Typically, control of the fire signal timing and the voltage level of the power supply works well for smaller printheads having smaller swath heights and for printheads capable of printing only a single color. These printheads tend to be relatively easier to control as they only need one fire signal to control the ejection of ink drops from the printhead.

With single color printheads having larger swath heights, thermal gradients can become pronounced. The thermal gradients can result in drop volume variation across the printhead. To offset this effect, the fire pulse width can be adjusted while printing using approaches such as dynamic pulse width adjustment (DPWA) algorithms. With large thermal gradients, there may not be a high enough degree of control in the DPWA algorithms to control the drop generator energy across the printhead.

Multiple color printheads which use black drop generators at higher drop volumes and color drop generators at lower drop volumes can also be difficult to control. Higher volume drop generators require a higher turn on energy than lower volume drop generators. Consequently, the ejection of ink drops from multiple color printheads can be difficult to control.

For reasons stated above and for other reasons presented in the Detailed Description section of the present specification, a fluid ejection device is desired which provides greater control of drop generator energy across the printhead.

SUMMARY OF THE INVENTION

One aspect of the present invention provides a fluid ejection device which includes nozzles and includes firing resistors corresponding to the nozzles. In one embodiment, each firing resistor and corresponding nozzle are located in zones on the fluid ejection device, wherein each zone has at least one firing resistor and corresponding nozzle. In one embodiment, addressable select logic responsive to a select address couples multiple fire pulses to the firing resistors in the zones so that selected firing resistors in the same zone are coupled to the same fire pulse.

DETAILED DESCRIPTION

In the following detailed description of the preferred embodiments, reference is made to the accompanying drawings which form a part hereof, and in which is shown by way of illustration specific embodiments in which the invention may be practiced. In this regard, directional terminology, such as "top," "bottom," "front," "back," "leading," "trailing," etc., is used with reference to the orientation of the Figure(s) being described. The fluid ejection system and related components of the present invention can be positioned in a number of different orientations. As such, the directional terminology is used for purposes of illustration and is in no way limiting. It is to be understood that other embodiments may be utilized and structural or logical changes may be made without departing from the scope of the present invention. The following detailed description, therefore, is not to be taken in a limiting sense, and the scope of the present invention is defined by the appended claims.

Figure 1:
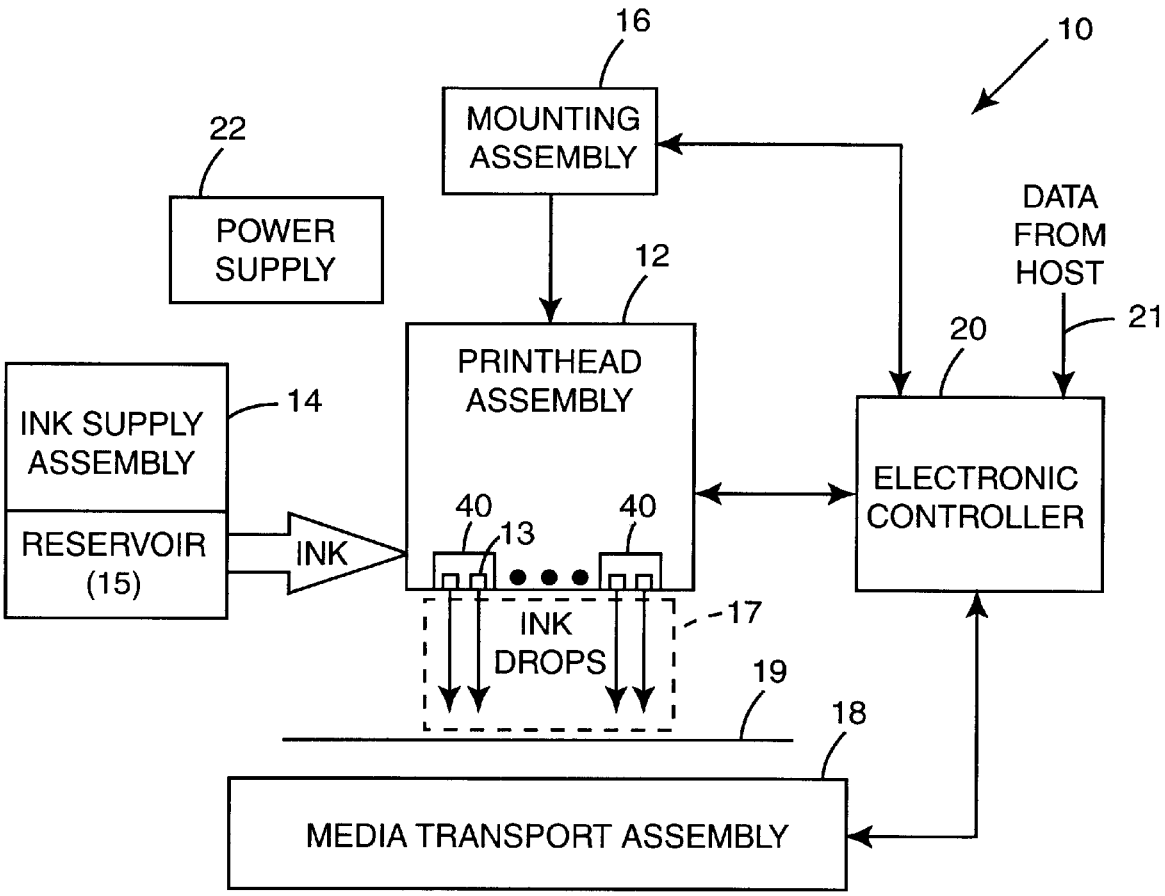
FIG. 1 is a block diagram illustrating one embodiment of an inkjet printing system.

FIG. 1 illustrates one embodiment of a fluid ejection system referred to as an inkjet printing system 10 which ejects ink. Other embodiments of fluid ejection systems include printing and non-printing systems, such as medical fluid delivery systems, which eject fluids including liquids, such as water, ink, blood, photoresist, or organic light-emitting materials, or flowable particles of a solid, such as talcum powder or a powered drug.

In one embodiment, the fluid ejection system includes a fluid ejection assembly, such as an inkjet printhead assembly 12; and a fluid supply assembly, such as an ink supply assembly 14. In the illustrated embodiment, inkjet printing system 10 also includes a mounting assembly 16, a media transport assembly 18, and an electronic controller 20. At least one power supply 22 provides power to the various electrical components of inkjet printing system 10. In one embodiment, the fluid ejection assembly includes at least one fluid ejection device, such as at least one printhead or printhead die 40. In the illustrated embodiment, each printhead 40 ejects drops of ink through a plurality of orifices or nozzles 13 and toward a print medium 19 so as to print onto print medium 19. Print medium 19 is any type of suitable sheet material, such as paper, card stock, transparencies, Mylar, and the like. Typically, nozzles 13 are arranged in one or more columns or arrays such that properly sequenced ejection of ink from nozzles 13 causes characters, symbols, and/or other graphics or images to be printed upon print medium 19 as inkjet printhead assembly 12 and print medium 19 are moved relative to each other.

Ink supply assembly 14 supplies ink to printhead assembly 12 and includes a reservoir 15 for storing ink. As such, ink flows from reservoir 15 to inkjet printhead assembly 12. Ink supply assembly 14 and inkjet printhead assembly 12 can form either a one-way ink delivery system or a recirculating ink delivery system. In a one-way ink delivery system, substantially all of the ink supplied to inkjet printhead assembly 12 is consumed during printing. In a recirculating ink delivery system, however, only a portion of the ink supplied to printhead assembly 12 is consumed during printing. As such, ink not consumed during printing is returned to ink supply assembly 14.

In one embodiment, inkjet printhead assembly 12 and ink supply assembly 14 are housed together in an inkjet cartridge or pen. In another embodiment, ink supply assembly 14 is separate from inkjet printhead assembly 12 and supplies ink to inkjet printhead assembly 12 through an interface connection, such as a supply tube. In either embodiment, reservoir 15 of ink supply assembly 14 may be removed, replaced, and/or refilled. In one embodiment, where inkjet printhead assembly 12 and ink supply assembly 14 are housed together in an inkjet cartridge, reservoir 15 includes a local reservoir located within the cartridge as well as a larger reservoir located separately from the cartridge. As such, the separate, larger reservoir serves to refill the local reservoir. Accordingly, the separate, larger reservoir and/or the local reservoir may be removed, replaced, and/or refilled.

Mounting assembly 16 positions inkjet printhead assembly 12 relative to media transport assembly 18 and media transport assembly 18 positions print medium 19 relative to inkjet printhead assembly 12. Thus, a print zone 17 is defined adjacent to nozzles 13 in an area between inkjet printhead assembly 12 and print medium 19. In one embodiment, inkjet printhead assembly 12 is a scanning type printhead assembly. As such, mounting assembly 16 includes a carriage for moving inkjet printhead assembly 12 relative to media transport assembly 18 to scan print medium 19. In another embodiment, inkjet printhead assembly 12 is a non-scanning type printhead assembly. As such, mounting assembly 16 fixes inkjet printhead assembly 12 at a prescribed position relative to media transport assembly 18. Thus, media transport assembly 18 positions print medium 19 relative to inkjet printhead assembly 12.

Electronic controller or printer controller 20 typically includes a processor, firmware, and other printer electronics for communicating with and controlling inkjet printhead assembly 12, mounting assembly 16, and media transport assembly 18. Electronic controller 20 receives data 21 from a host system, such as a computer, and includes memory for temporarily storing data 21. Typically, data 21 is sent to inkjet printing system 10 along an electronic, infrared, optical, or other information transfer path. Data 21 represents, for example, a document and/or file to be printed. As such, data 21 forms a print job for inkjet printing system 10 and includes one or more print job commands and/or command parameters.

In one embodiment, electronic controller 20 controls inkjet printhead assembly 12 for ejection of ink drops from nozzles 13. As such, electronic controller 20 defines a pattern of ejected ink drops which form characters, symbols, and/or other graphics or images on print medium 19. The pattern of ejected ink drops is determined by the print job commands and/or command parameters.

In one embodiment, inkjet printhead assembly 12 includes one printhead 40. In another embodiment, inkjet printhead assembly 12 is a wide-array or multi-head printhead assembly. In one wide-array embodiment, inkjet printhead assembly 12 includes a carrier, which carries printhead dies 40, provides electrical communication between printhead dies 40 and electronic controller 20, and provides fluidic communication between printhead dies 40 and ink supply assembly 14.

Figure 2:
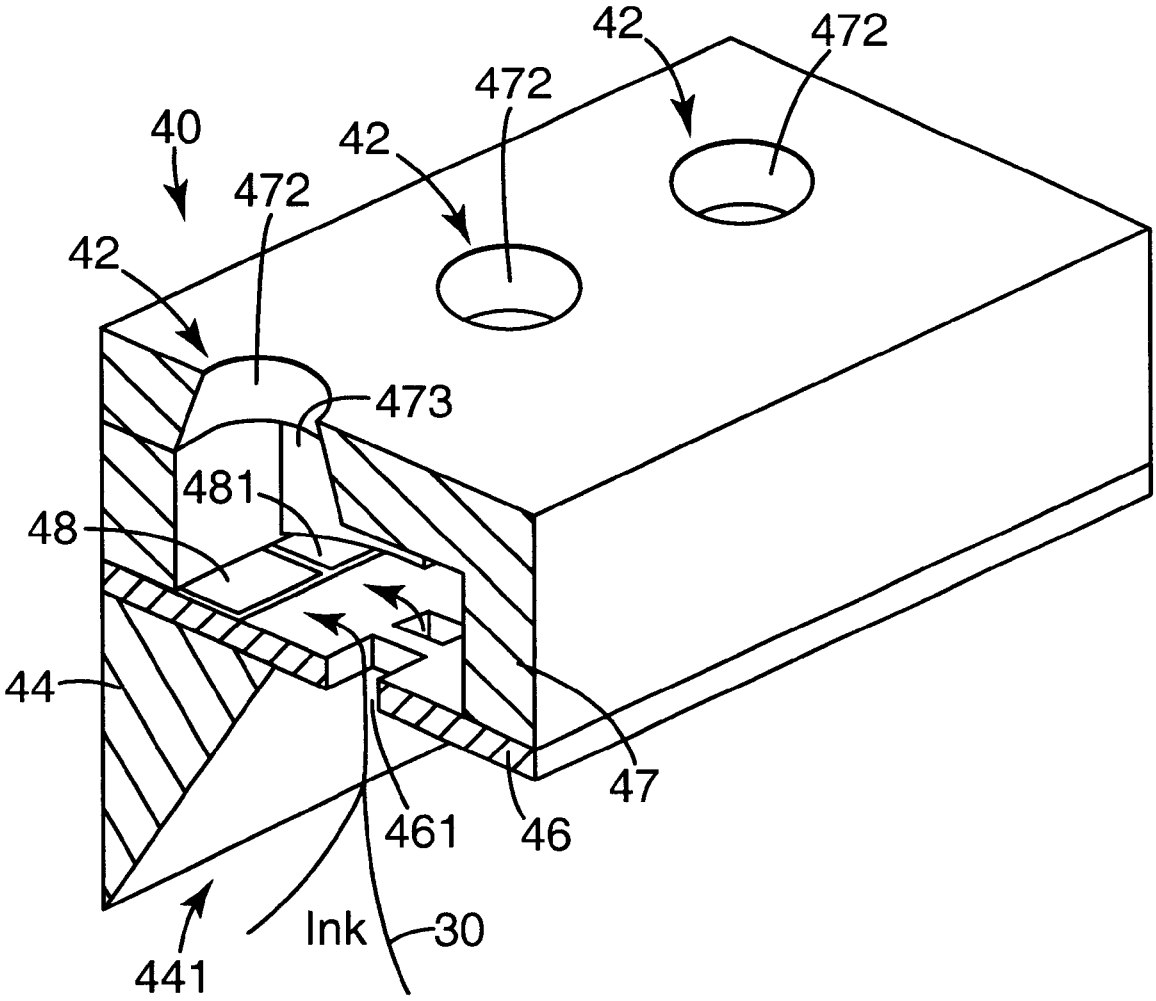
FIG. 2 is an enlarged schematic cross-sectional view illustrating portions of one embodiment of a printhead die in the printing system of FIG. 1.

A portion of one embodiment of a printhead die 40 is illustrated in a cross-sectional perspective view in FIG. 2. Printhead die 40 includes an array of drop ejection elements or drop generators 42. Drop generators 42 are formed on a substrate 44 which has an ink feed slot 441 formed therein. Ink feed slot 441 provides a supply of ink to drop generators 42. Printhead die 40 includes a thin-film structure 46 on top of substrate 44. Printhead die 40 includes an orifice layer 47 on top of thin-film structure 46.

Each drop generator 42 includes a nozzle 472, a vaporization chamber 473, and a firing resistor 48. Thin-film structure 46 has an ink feed channel 461 formed therein which communicates with ink feed slot 441 formed in substrate 44. Orifice layer 47 has nozzles 472 formed therein. Orifice layer 47 also has vaporization chamber 473 formed therein which communicates with nozzles 42 and ink feed channel 461 formed in thin-film structure 46. Firing resistor 48 is positioned within vaporization chamber 473. Leads 481 electrically couple firing resistor 48 to circuitry controlling the application of electrical current through selected firing resistors.

During printing, ink 30 flows from ink feed slot 441 to nozzle chamber 473 via ink feed channel 461. Each nozzle 472 is operatively associated with a corresponding firing resistor 48, such that droplets of ink within vaporization chamber 473 are ejected through the selected nozzle 472 (e.g., normal to the plane of the corresponding firing resistor 48) and toward a print medium upon energization of the selected firing resistor 48.

Thin-film structure 46 is also herein referred to as a thin-film membrane 46. In one example embodiment, containing four offset columns of nozzles, two columns are formed on one thin-film membrane 46 and two columns are formed on another thin-film membrane 46.

Example embodiments of printhead dies 40 include a thermal printhead, a piezoelectric printhead, a flex-tensional printhead, or any other type of inkjet ejection device known in the art. In one embodiment, printhead dies 40 are fully integrated thermal inkjet printheads. As such, substrate 44 is formed, for example, of silicon, glass, or a stable polymer and thin-film structure 46 is formed by one or more passivation or insulation layers of silicon dioxide, silicon carbide, silicon nitride, tantalum, poly-silicon glass, or other suitable material. Thin-film structure 46 also includes a conductive layer which defines firing resistor 48 and leads 481. The conductive layer is formed, for example, by aluminum, gold, tantalum, tantalum-aluminum, or other metal or metal alloy.

Printhead assembly 12 can include any suitable number (P) of printheads 40, where P is at least one. Before a print operation can be performed, data must be sent to printhead 40. Data includes, for example, print data and non-print data for printhead 40. Print data includes, for example, nozzle data containing pixel information, such as bitmap print data. Non-print data includes, for example, command/status (CS) data, clock data, and/or synchronization data. Status data of CS data includes, for example, printhead temperature or position, printhead resolution, and/or error notification.

Figure 3:
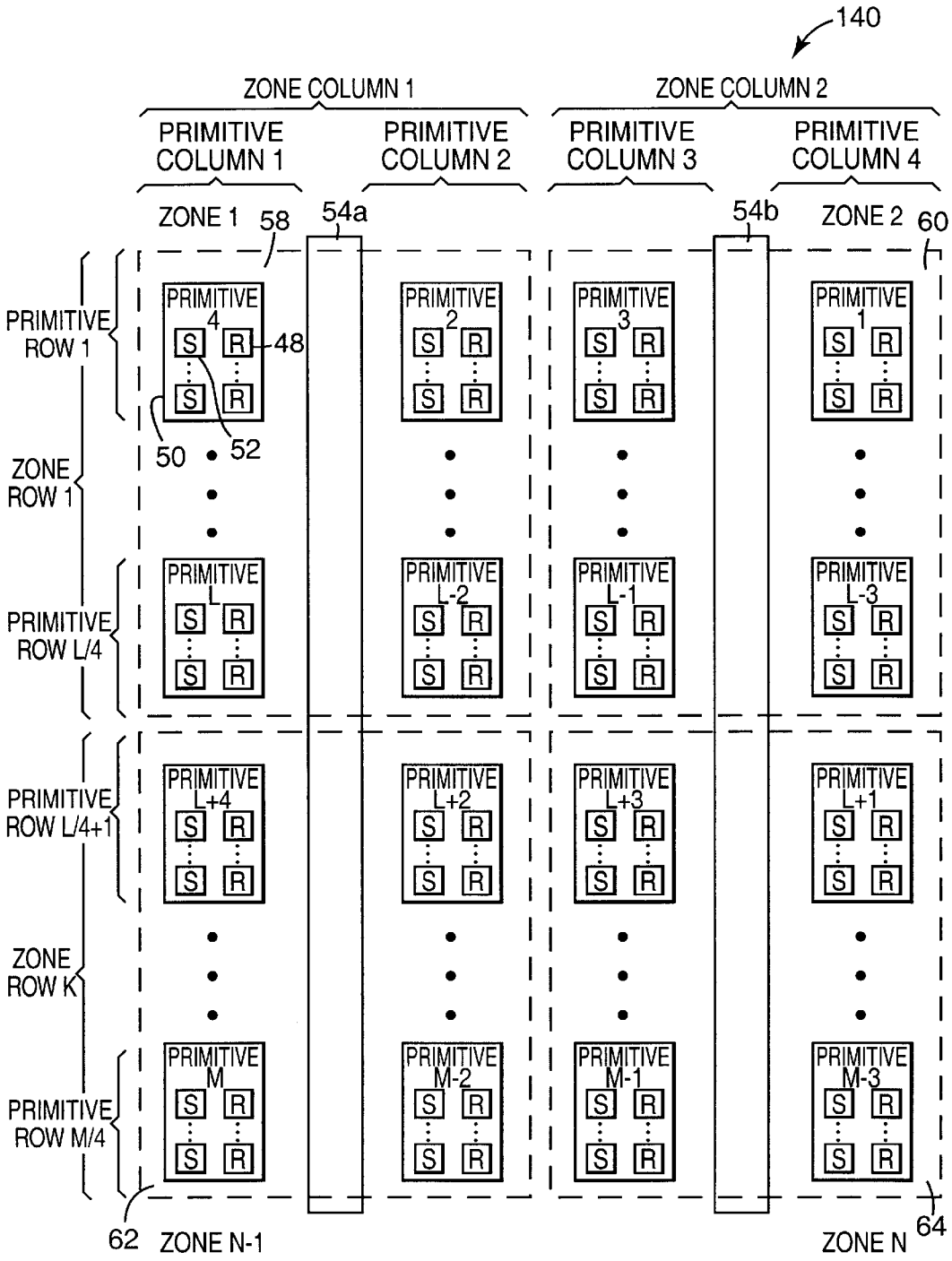
FIG. 3 is a block diagram of one embodiment of an inkjet printhead having primitives which are grouped into zones.

One embodiment of printhead 140 is illustrated generally in block diagram form in FIG. 3. Printhead 140 includes multiple firing resistors 48 which are grouped together into primitives 50. In one embodiment, the number of firing resistors 48 in each primitive 50 can vary from primitive to primitive. In one embodiment, the number of firing resistors 48 is the same for each primitive 50.

Each firing resistor 48 has an associated switching device 52 such as a field effect transistor (FET). In one embodiment, a single power lead provides power to each FET 52 and firing resistor 48 in each primitive 50. In one embodiment, each FET 52 in a primitive 50 is controlled with a separately energizable address lead coupled to the gate of the FET 52. In one embodiment, each address lead is shared by multiple primitives 50. The address leads are controlled so that only one FET 52 is switched on at a given time so that at most a single firing resistor 48 in a primitive 50 has electrical current passed through it to heat the ink in the corresponding nozzle vaporization chamber at the given time.

In the example embodiment illustrated in FIG. 3, primitives 50 are arranged in printhead 140 in rows and columns. Each row includes four primitives 50. Row 1 includes primitive 1, primitive 2, primitive 3 and primitive 4. Row L/4 includes primitive L−3, primitive L−2, primitive L−1 and primitive L. Row L/4+1 includes primitive L+1, primitive L+2, primitive L+3 and primitive L+4. While FIG. 3 illustrates four columns of primitives 50 (primitive column 1 through primitive column 4), and two columns of zones (zone column 1 and zone column 2), in other embodiments there can be any suitable number of columns of primitives 50 and any suitable number of columns of zones. Row M/4 includes primitive M−3, primitive M−2, primitive M−1 and primitive M. In various embodiments, there can be any suitable number of rows of primitives 50, wherein the number of rows are greater than or equal to one. In various embodiments, there can be any suitable number of primitives 50 in a row, wherein the number of primitives are greater than or equal to one. In various embodiments, there is at least one row of primitives 50 per zone and at least one primitive 50 per zone.

In the example embodiment illustrated in FIG. 3, printhead 140 further includes ink feed slots 54, such as ink feed slot 54*a* and ink feed slot 54*b*. The ink feed slots 54 provide a supply of liquid ink to the nozzle vaporization chambers so that the ink may be heated by the corresponding resistors. Ink feed slot 54*a* is in fluid communication with and provides ink to the nozzles and corresponding resistors in primitive 2, primitive 4, primitive L−2, primitive L, primitive L+2, primitive L+4, primitive M−2 and primitive M. Ink feed slot 54*b* is in fluid communication with and provides ink to the nozzles and corresponding resistors in primitive 1, primitive 3, primitive L−3, primitive L−1, primitive L+1, primitive L+3, primitive M−3 and primitive M−1. In the example embodiment illustrated in FIG. 3, printhead 140 includes two ink feed slots 54. One embodiment of the inkjet printhead includes one ink feed slot. Other embodiments of the inkjet printhead include more than two ink feed slots.

In the embodiment illustrated in FIG. 3, the primitives 50 on printhead 140 are partitioned into zones. In one embodiment, each zone is defined to include only the nozzles in fluid communication with one ink feed slot 54. In one embodiment, each ink feed slot 54 has at least one zone. Each zone defines an area within printhead 140 wherein all of the firing resistors 48 and FETs 52 within each primitive 50 are coupled to a common power lead and decoded fire pulse. In embodiments described below, printhead 140 includes addressable select logic referred to as zone decode logic to route each fire pulse to each zone.

A common power lead and fire pulse is used within each zone because it is desirable to control the energy supplied to resistor 48 and FET 52 within each primitive 50 in a particular zone for an ink color which is supplied by either ink feed slot 54*a* or ink feed slot 54*b*. In one embodiment, certain individual colors such as black may be required to be used at higher drop volumes than other colors, and as such, nozzles for the color black require higher energies to vaporize the ink. The energy can be varied with the power lead or fire pulse by changing either the pulse width of the fire pulse or the peak voltage of the power supply applied to the particular zone. In one embodiment, the temperature of printhead 140 can also be regulated during printing by reducing the pulsewidth of the fire pulse to reduce the energy supplied to the nozzle as printhead 140 warms up.

In the embodiment illustrated in FIG. 3, the zones are organized on printhead 140 in rows and columns. In other embodiments, the zones may be organized in other arrangements or patterns. Zone 1 is illustrated at 58, zone 2 is illustrated at 60, zone N−1 is illustrated at 62, and zone N is illustrated at 64, where N is any suitable number equal to or greater than two. In the embodiment illustrated in FIG. 3, there are K row groups of zones, where K is any suitable number equal to or greater than one.

Figure 4:
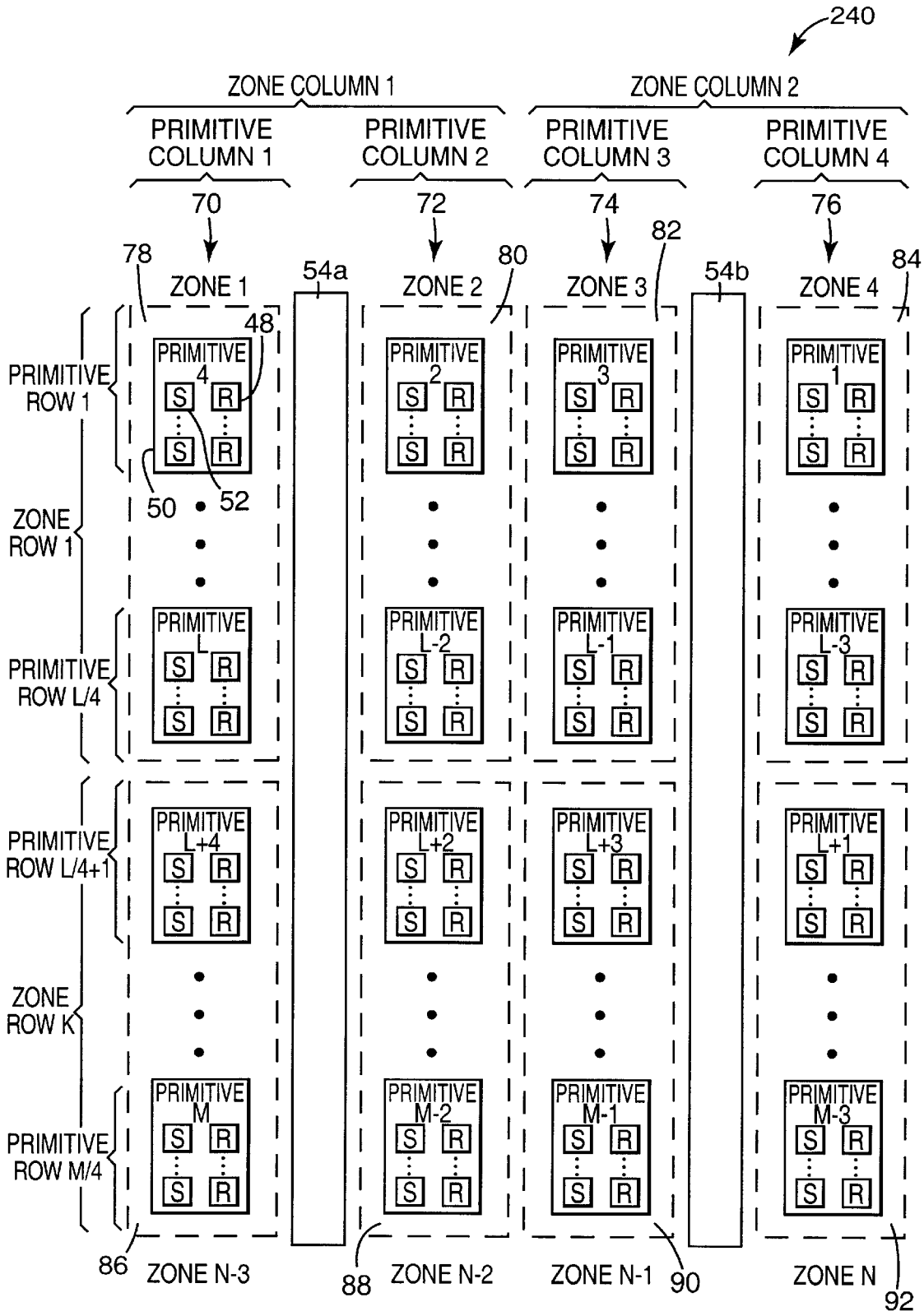
FIG. 4 is a block diagram of one embodiment of an inkjet printhead having primitives which are grouped into zones.

FIG. 4 is a block diagram illustrating one embodiment of an inkjet printhead 240 including primitives 50 which are grouped into zones. In embodiments described below, printhead 240 includes addressable select logic referred to as zone decode logic to route each fire pulse to each zone.

In the embodiment illustrated in FIG. 4, primitives 50 in printhead 240 are disposed on printhead 240 to be adjacent to the ink feed slots 54 on either a first side or a second side of the ink feed slots 54, wherein the nozzles are in fluid communication with the adjacent ink feed slots 54. In the embodiment illustrated in FIG. 4, ink feed slot 54*a* includes a first side 70 and a second side 72. Ink feed slot 54*b* includes a first side 74 and a second side 76. Zone 1 at 78 includes primitive 4 and primitive L on first side 70 of ink feed slot 54*a*. Zone 2 at 80 includes primitive 2 and primitive L−2 on second side 72 of ink feed slot 54*a*. Zone 3 at 82 includes primitive 3 and primitive L−1 on first side 74 of ink feed slot 54*b*. Zone 4 at 84 includes primitive 1 and primitive L−3 on second side 76 of ink feed slot 54*b*. Zone N−3 at 86 includes primitive L+4 and primitive M on first side 70 of ink feed slot 54*a*. Zone N−2 at 88 includes primitive L+2 and primitive M−2 on second side 72 of ink feed slot 54*a*. Zone N−1 at 90 includes primitive L+3 and primitive M−1 on first side 74 of ink feed slot 54*b*. Zone N at 92 includes primitive L+1 and primitive M−3 on second side 76 of ink feed slot 54*b*. In the embodiment illustrated in FIG. 4, there are K row groups of zones.

Each zone is coupled to a power supply and a decoded fire pulse lead so that the drop generator energy can be independently controlled in each zone during printing. In one embodiment, each zone is defined to include only the nozzles in fluid communication with one common ink feed slot. In one embodiment, each ink feed slot has at least one zone. In one embodiment, the zones on first side 70 and second side 72 of ink feed slot 54*a* have nozzles in primitives 50 which are in fluid communication with ink feed slot 54*a*. In one embodiment, the zones on first side 74 and second side 76 of ink feed slot 54*b* have nozzles in primitives 50 which are in fluid communication with ink feed slot 54*b*. In other embodiments, the zones contain nozzles in primitives 50 which are in fluid communication with more than one ink feed slot 54.

Figure 5:
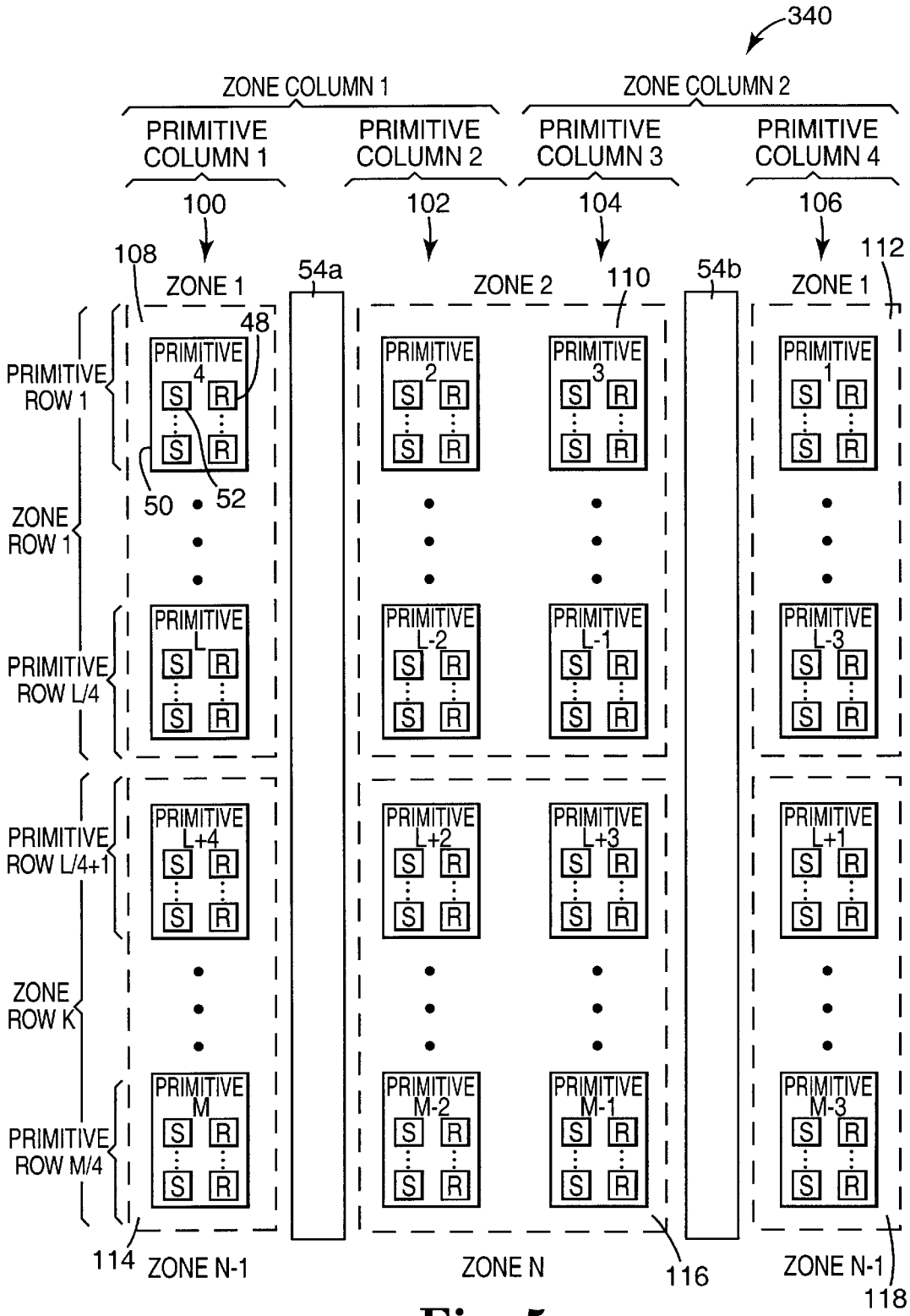
FIG. 5 is a block diagram of one embodiment of an inkjet printhead having primitives which are grouped into zones.

FIG. 5 is a block diagram illustrating one embodiment of an inkjet printhead 340 including primitives 50 which are grouped into zones. In embodiments described below, printhead 340 includes addressable select logic referred to as zone decode logic to route each fire pulse to each zone.

In the embodiment illustrated in FIG. 5, a zone is defined to include nozzles in fluid communication with adjacent ink feed slots 54. In FIG. 5, ink feed slot 54*a* is adjacent to ink feed slot 54*b*. Zone 2 at 110 has primitive 2 and primitive L−2 adjacent to ink feed slot 54*a* on a second side 102 of ink feed slot 54*a* where the nozzles in primitive 2 and primitive L−2 are in fluid communication with ink feed slot 54*a*. Zone 2 also has primitive 3 and primitive L−1 adjacent to ink feed slot 54*b* on a first side 104 of ink feed slot 54*b* where the nozzles in primitive 3 and primitive L−1 are in fluid communication with ink feed slot 54*b*. Thus zone 2 has nozzles in fluid communication with both ink feed slot 54*a* and ink feed slot 54*b*.

Zone N at 116 also has nozzles in fluid communication with both ink feed slot 54*a* and ink feed slot 54*b*. Zone N has primitive L+2 and primitive M−2 adjacent to ink feed slot 54*a* on a second side 102 of ink feed slot 54*a* where the nozzles in primitive L+2 and primitive M−2 are in fluid communication with ink feed slot 54*a*. Zone N also has primitive L+3 and primitive M−1 adjacent to ink feed slot 54*b* on a first side 104 of ink feed slot 54*b* where the nozzles in primitive L+3 and primitive M−1 are in fluid communication with ink feed slot 54*b*.

FIG. 5 illustrates one embodiment wherein a zone is defined to include nozzles in fluid communication with adjacent ink feed slots wherein the zones are not contiguous. Zone 1 at 108 includes primitive 4 and primitive L on first side 100 of ink feed slot 54*a*, wherein the nozzles in primitive 4 and primitive L are in fluid communication with ink feed slot 54*a*. Zone 1 at 112 includes primitive 1 and primitive L−3 on second side 106 of ink feed slot 54*b*, wherein the nozzles in primitive 1 and primitive L−3 are in fluid communication with ink feed slot 54*b*. Zone N−1 at 114 includes primitive L+4 and primitive M on first side 100 of ink feed slot 54*a*, wherein the nozzles in primitive L+4 and primitive M are in fluid communication with ink feed slot 54*a*. Zone N−1 at 118 includes primitive L+1 and primitive M−3 on second side 106 of ink feed slot 54*b*, wherein the nozzles in primitive L+1 and primitive M−3 are in fluid communication with ink feed slot 54*b*.

Figure 6:
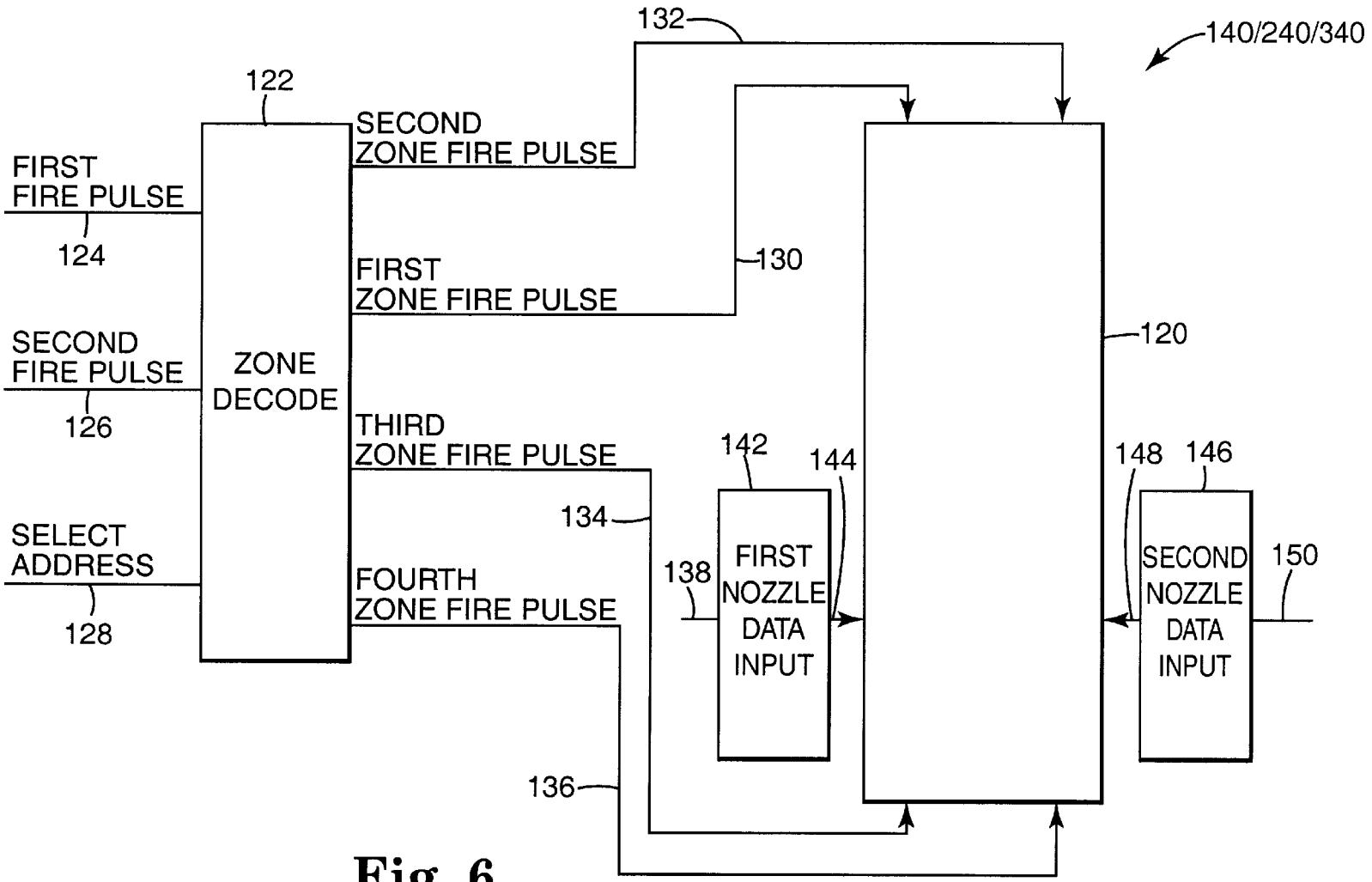
FIG. 6 is a block diagram of one embodiment of fire pulse decoding logic in a printhead for decoding multiple fire pulses.

FIG. 6 is a block diagram illustrating one embodiment of portions of a printhead 140/240/340 having addressable select logic referred to as zone decode logic 122 for decoding multiple fire pulses. In the embodiment illustrated in FIG. 6, zone decode logic 122 is responsive to a select address 128 and couples a first fire pulse 124 and a second fire pulse 126 to the firing resistors in the zones within printhead 140/240/340 so that each firing resistor in each zone is coupled to a same fire pulse.

In the example embodiment illustrated in FIG. 6, zone decode logic 122 receives first fire pulse 124, second fire pulse 126, and select address 128 and provides a selected one of the first or second fire pulses on each of a first zone fire pulse line 130, a second zone fire pulse line 132, a third zone fire pulse line 134, and a fourth zone fire pulse line 136 to an array 120 of primitives 50, which are partitioned into zones. First zone fire pulse line 130 is coupled to all of the firing resistors in zone 1. Second zone fire pulse line 132 is coupled to all of the firing resistors in zone 2. Third zone fire pulse line 134 is coupled to all of the firing resistors in zone 3. Fourth zone fire pulse line 136 is coupled to all of the firing resistors in zone 4.

In one example embodiment, the printhead illustrated in FIG. 6 is implemented in the configuration of printhead 140 illustrated in FIG. 3 where L is equal to 88, M is equal to 176, N is equal to 4, and K is equal to 2. With N equal to 4, zone N−1 is zone 3 and zone N is zone 4. With K equal to 2, there are two rows of primitives, row 1 and row 2. With L equal to 88, zone 1 and zone 2 have 88 primitives. With M equal to 176, zone 3 and zone 4 have 88 primitives. In the example embodiment, printhead 140 has 176 primitives 50.

In the example embodiment, each primitive 50 includes 12 firing resistors 48 and 12 corresponding nozzles, wherein each firing resistor 48 corresponds to a unique nozzle. At 12 nozzles per primitive, the nozzles in each zone are arranged as 44 primitives of 12 nozzles. This gives a total primitive 50 count in printhead 140 of 176 primitives. In the example embodiment, ink slot 1 at 54 is in fluid communication with the 1056 nozzles in zone 1 and zone 3, and ink slot 2 at 56 is in fluid communication with the 1056 nozzles in zone 2 and zone 4. In the example embodiment, zone 1 at 58 has 528 nozzles, zone 2 at 60 has 528 nozzles, zone 3 at 62 has 528 nozzles, and zone 4 at 64 has 528 nozzles.

In the example embodiment, if select address 128 is a first select address, zone decode logic 122 couples first fire pulse 124 respectively via the first zone fire pulse line 130 and the second zone fire pulse line 132 to the array 120 of primitives 50 in zone 1 and zone 2 in row 1 and couples second fire pulse 126 respectively via the third zone fire pulse line 134 and the fourth zone fire pulse line 136 to the array 120 of primitives 50 in zone 3 and zone 4 in row 2. If select address 128 is a second select address, zone decode logic 122 couples first fire pulse 124 respectively via the second zone fire pulse line 132 and the fourth zone fire pulse line 136 to the array 120 of primitives 50 in zone 2 and zone 4 in column 2 and couples second fire pulse 126 respectively via the first zone fire pulse line 130 and the third zone fire pulse line 134 to the array 120 of primitives 50 in zone 1 and zone 3 in column 1.

In one embodiment, the actual selection of nozzles which will fire is controlled by first nozzle data input 142, which is coupled to printhead 140 via signal line 144, and by second nozzle data input 146, which is coupled to printhead 140 via signal line 148. In one embodiment, first nozzle data input 142 is coupled to electronic controller 20 via signal line 138, and second nozzle data input 146 is coupled to electronic controller 20 via signal line 150, so that first nozzle data input 142 and second nozzle data input 146 can receive nozzle data from electronic controller 20.

In one embodiment, if the select address is the first select address, first fire pulse 124 controls zone 1 and zone 2 of printhead 140 which each have 44 primitives for a total of 88 primitives. Because each primitive has 12 nozzles with only one of the 12 corresponding firing resistors 48 being fired at any one time, a maximum of 88 firing resistors are fired at any time in zone 1 and zone 2. If the select address is the first select address, second fire pulse 126 controls zone 3 and zone 4 of printhead 140 which each have 44 primitives for a total of 88 primitives. Because each primitive has 12 nozzles with only one of the 12 corresponding firing resistors 48 being fired at any one time, a maximum of 88 firing resistors are fired at any time in zone 3 and zone 4.

In one embodiment, if the select address is the second select address, first fire pulse 124 controls zone 2 and zone 4 of printhead 140 which each have 44 primitives for a total of 88 primitives. Because each primitive has 12 nozzles with only one of the 12 corresponding firing resistors 48 being fired at any one time, a maximum of 88 firing resistors are fired any time in zone 2 and zone 4. If the select address is the second select address, second fire pulse 126 controls zone 1 and zone 3 of printhead 140 which each have 44 primitives for a total of 88 primitives. Because each primitive has 12 nozzles with only one of the 12 corresponding firing resistors 48 being fired at any one time, a maximum of 88 firing resistors are fired at any time in zone 1 and zone 3.

In one embodiment, each of the two fire signals, first fire pulse 124 and second fire pulse 126, are independent in operation. In one embodiment, either first fire pulse 124 or second fire pulse 126 can be fired alone. In one embodiment, first fire pulse 124 and second fire pulse 126 are synchronous and vary only in pulse width.

Figure 7:
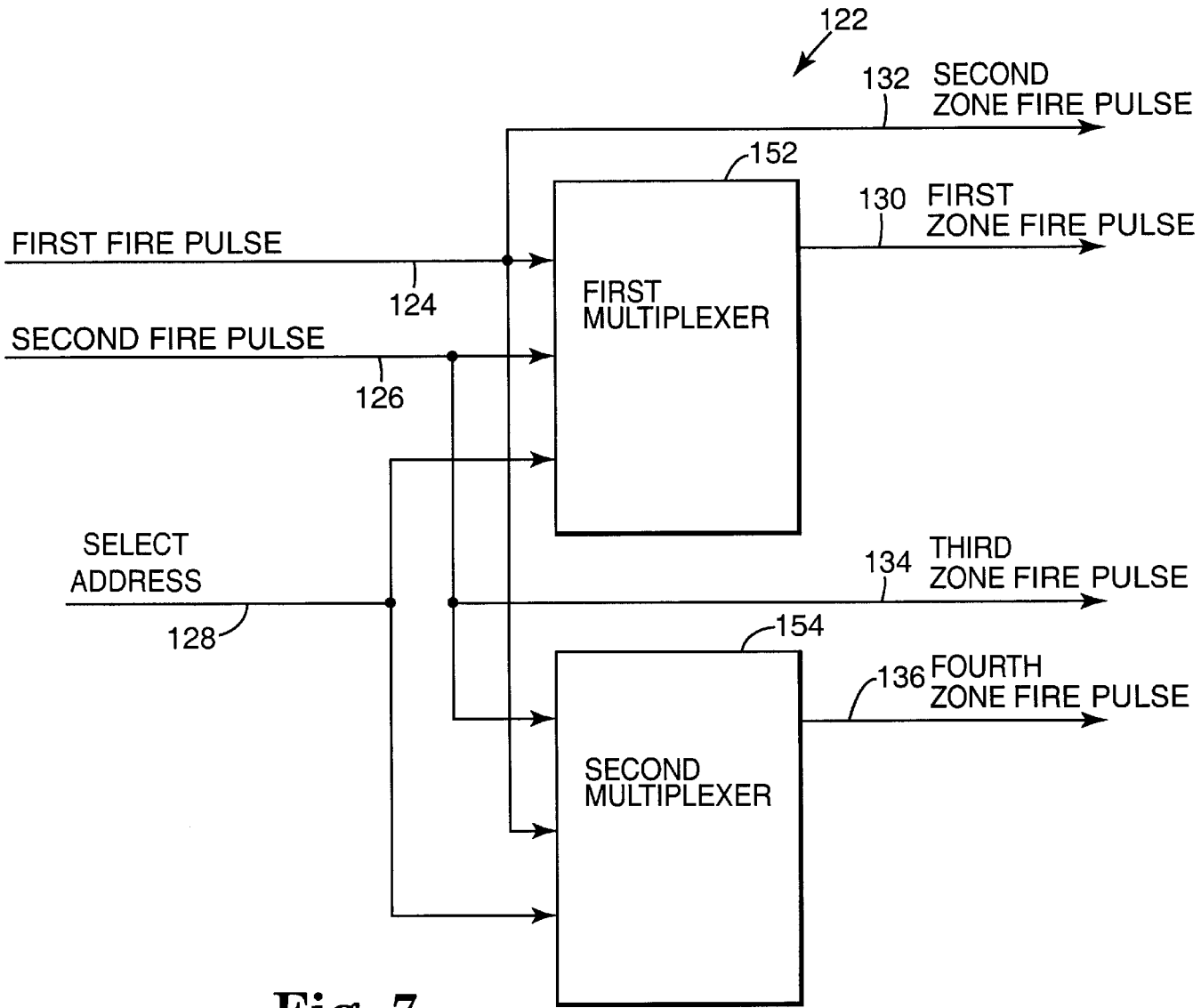
FIG. 7 is a block diagram of one embodiment of zone decode logic.

FIG. 7 is a block diagram of one embodiment of zone decode logic 122. Zone decode logic 122 includes first multiplexer 152 and second multiplexer 154. First multiplexer 152 receives first fire pulse 124, second fire pulse 126, and select address 128, and provides a selected one of the first or second fire pulse on first zone fire pulse line 130. First zone fire pulse line 130 couples to all of the firing resistors 48 in the first zone of primitive array 120. Second multiplexer 154 receives first fire pulse 124, second fire pulse 126, and select address 128, and provides a selected one of the first or second fire pulse on fourth zone fire pulse line 136. Fourth zone fire pulse line 136 couples to all of the firing resistors 48 in the fourth zone of primitive array 120. First fire pulse 124 is coupled to second zone fire pulse line 132, which is coupled to all of the firing resistors 48 in the second zone of primitive array 120. Second fire pulse 126 is coupled to third zone fire pulse line 134, which is coupled to all of the firing resistors in the third zone of primitive array 120. In one embodiment, first fire pulse 124 and second fire pulse 126 are coupled to electronic controller 20 to receive firing pulse information from electronic controller 20.

In other embodiments, one or more multiplexers may be used. In other embodiments, one or more of the fire pulse signals may couple directly to the firing resistors in particular zones, or may couple through one or more multiplexers to the firing resistors in particular zones, depending on the particular arrangement of the zones on the printhead.

In one embodiment, the select address is a single line having two possible logical values, which are "0" to define the first select address and "1" to define the second select address. If select address is at a "0" logic value, first multiplexer 152 couples first fire pulse 124 to all of the firing resistors 48 in the first zone via first zone fire pulse line 130, and second multiplexer 154 couples second fire pulse 126 to all of the firing resistors 48 in the fourth zone via fourth zone fire pulse line 136. Since first fire pulse 124 is coupled to all of the firing resistors 48 in the second zone via second zone fire pulse line 132, and second fire pulse 126 is coupled to all of the firing resistors in the third zone via third zone fire pulse line 134, when the select address is at a "0" logic value, first fire pulse 124 is coupled to all of the firing resistors 48 in the first zone and the second zone, which are in row 1 of primitive array 120, and second fire pulse 126 is coupled to all of the firing resistors 48 in the third zone and the fourth zone, which are in row 2 of primitive array 120.

In one embodiment, if the select address is at a "1" logic value, first multiplexer 152 couples second fire pulse 126 to all of the firing resistors 48 in the first zone via first zone fire pulse line 130, and second multiplexer 154 couples first fire pulse 124 to all of the firing resistors 48 in the fourth zone via fourth zone fire pulse line 136. Since first fire pulse 124 is coupled to all of the firing resistors 48 in the second zone via second zone fire pulse line 132, and second fire pulse 126 is coupled to all of the firing resistors in the third zone via third zone fire pulse line 134, when the select address is at a "1" logic value, first fire pulse 124 is coupled to all of the firing resistors 48 in the second zone and the fourth zone, which is column 2 of primitive array 120, and second fire pulse 126 is coupled to all of the firing resistors 48 in the first zone and the third zone, which is column 1 of primitive array 120.

Figure 8:
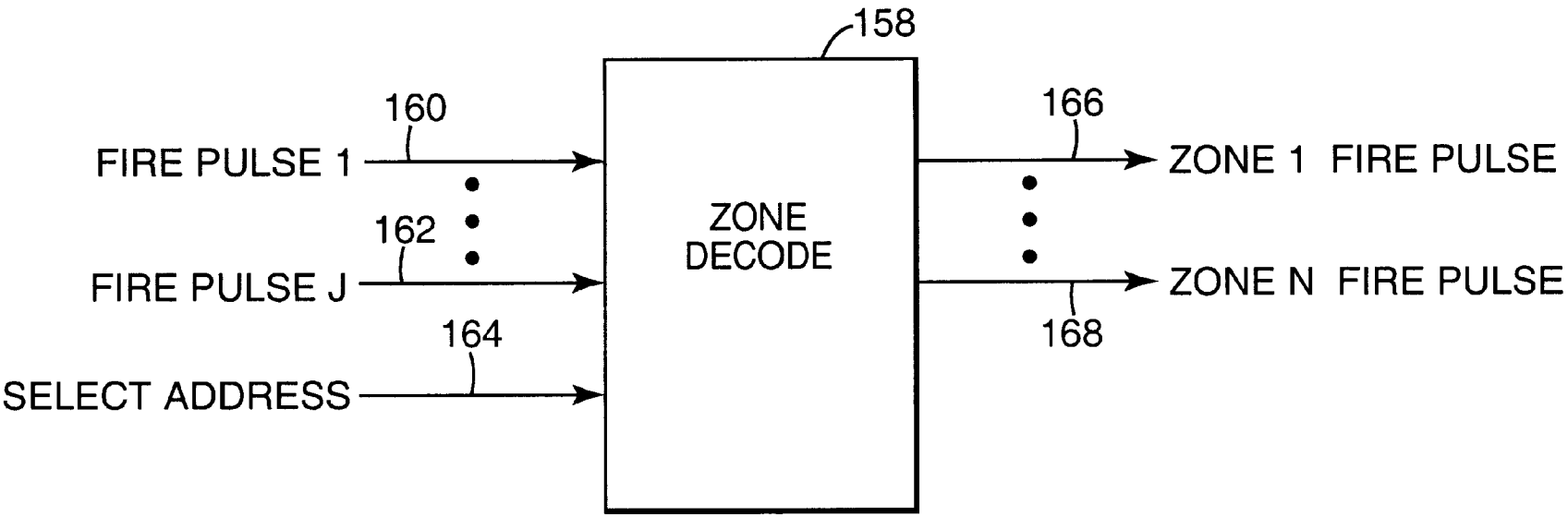
FIG. 8 is a block diagram of one embodiment of zone decode logic.

FIG. 8 is a block diagram of one embodiment of zone decode logic 158. Zone decode logic 158 receives multiple fire pulses indicated as fire pulse 1 at 160 through fire pulse J at 162. In one embodiment, J is any suitable number which is greater than one. Zone decode logic 158 further receives select address values via select address line 164.

Zone decode logic 158 provides a selected one of fire pulses 1 through J on each of N zone fire pulse lines, which respectively couple the selected fire pulses to the N zones. The N zone fire pulse lines are indicated as zone 1 fire pulse line at 166 through zone N fire pulse line at 168. In one embodiment, N is any suitable number which is greater than one.

In one embodiment, zone decode logic 158 has a number of states which are selected by the select address value on select address line 164. Each one of the number of states of zone decode logic 158 corresponds to a select address value on select address line 164 which selects the one of the number of states. Each one of the number of states of zone decode logic 158 also corresponds to zone decode logic 158 coupling, for each value of the select address, each fire pulse 1 at 160 through fire pulse J at 162, to a unique one or more of zone 1 fire pulse line at 166 through zone N fire pulse line at 168.

In other embodiments, there is a defined relationship between the number of fire pulses and the number of zones. In one embodiment, $N=J^2$ so that if there are J fire pulse inputs, zone decode logic 158 will couple the J fire pulse inputs to $J^2$ zone fire pulse lines and thereby to $J^2$ zones in the primitive array.

In one embodiment, the select address couples only two fire pulses to the zones. In this embodiment, the select address has two values. In another embodiment, the select address couples each of the fire pulse 1 at 160 through fire pulse J at 162 to each of the zone 1 at 166 through zone N at 168. In this embodiment, the select address must be sufficient to select 1 of N zones for each 1 through J fire pulse input, where N is any suitable number and J is any suitable number.

Figure 9:
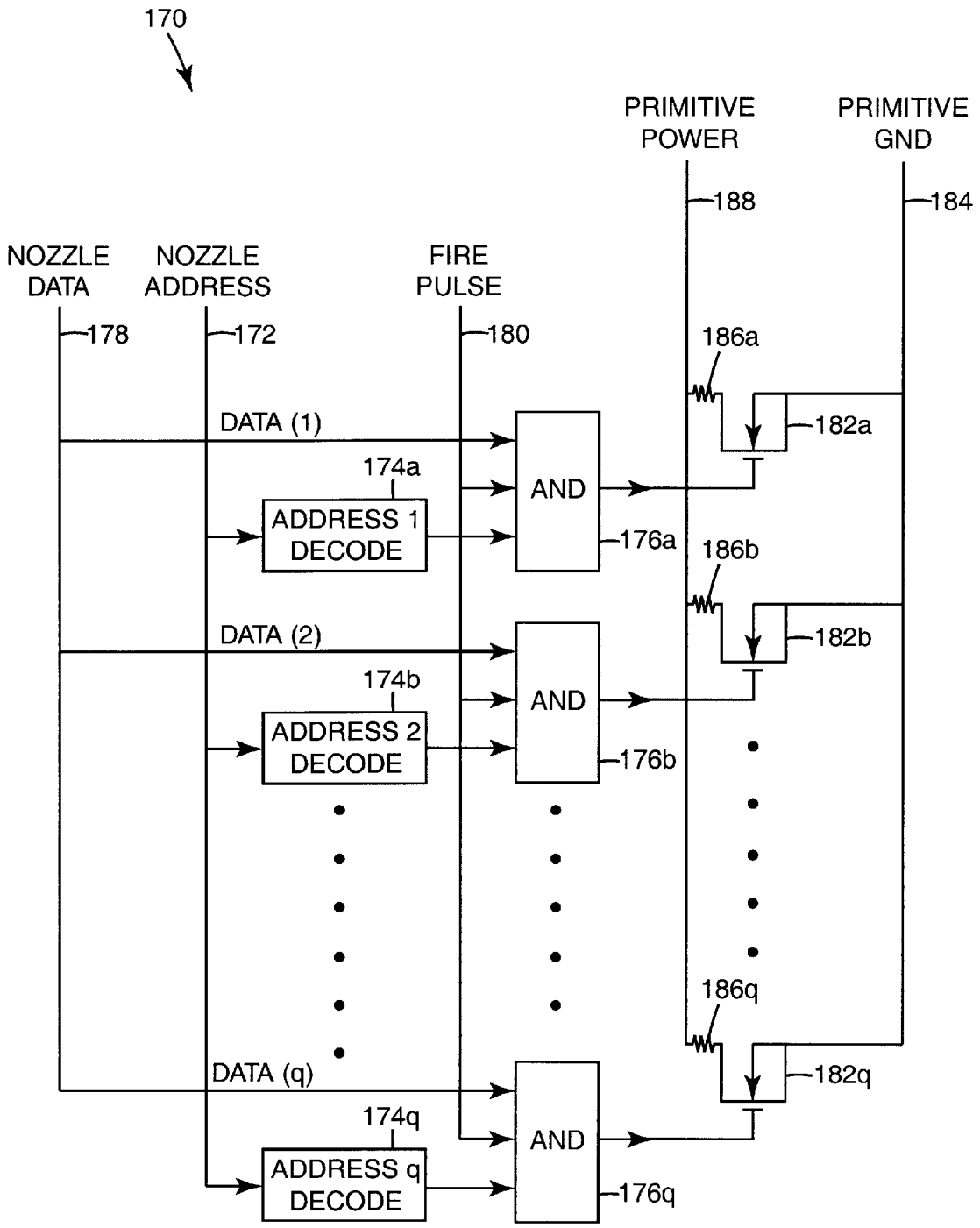
FIG. 9 is a block and schematic diagram illustrating portions of one embodiment of nozzle data input logic.

Portions of one embodiment of nozzle drive logic and circuitry for one primitive 50 are generally illustrated at 170 in block and schematic diagram form in FIG. 9. The portions illustrated in FIG. 9 represent the main logic and circuitry for implementing the nozzle firing operation of nozzle drive logic and circuitry 170, which receives nozzle data from first nozzle data input 142 and/or second nozzle data input 146 and a fire pulse from zone decode logic 122/158. However, practical implementations of nozzle drive logic and circuitry 170 can include various other complex logic and circuitry not illustrated in FIG. 9.

In the embodiment of nozzle drive logic and circuitry 170 illustrated in FIG. 9, a nozzle address is provided on a path 172 as an encoded address. Thus, the nozzle address on path 172 is provided to Q address decoders 174*a*, 174*b*, . . . , 174*q*. In one embodiment, the nozzle address on path 172 can represent one of Q addresses each representing one of Q nozzles in the primitive 50. Accordingly, each address decoder respectively provides an active output signal if the nozzle address represents the nozzle associated with the given address decoder.

Nozzle drive logic and circuitry 170 includes AND gates 176*a*, 176*b*, . . . , 176*q*, which receive the Q outputs from the address decoders 174*a*–174*q*. AND gates 176*a*–176*q* also respectively receive corresponding ones of the Q nozzle data bits from path 178. AND gates 176*a*–176*q* also each receive the fire pulse provided on path 180. The outputs of AND gates 176*a*–176*q* are respectively coupled to corresponding control gates of FETs 182*a*–182*q*.

Thus, for each AND gate 176, if the corresponding nozzle has been selected to receive data based on the nozzle data input bit from path 178, the fire pulse on line 180 is active, and the nozzle address on line 172 matches the address of the corresponding nozzle, the AND gate 176 activates its output which is coupled to the control gate of a corresponding FET 182.

Each FET 182 has its source coupled to primitive ground line 184 and its drain coupled to a corresponding firing resistor 186. Firing resistors 186*a*–186*q* are respectively coupled between primitive power line 188 and the drains of corresponding FETs 182*a*–182*q*.

Thus, when the combination of the nozzle data bit, the decoded address bit, and the fire pulse provide three active inputs to a given AND gate 176, the given AND gate 176 provides an active pulse to the control gate of the corresponding FET 182 to thereby turn on the corresponding FET 182 which correspondingly causes current to be passed from primitive power line 188 through the selected firing resistor 186 to primitive ground line 184. The electrical current being passed through the selected firing resistor 186 heats the ink in a corresponding selected vaporization chamber to cause the ink to vaporize and be ejected from the corresponding nozzle 472.

In one embodiment, Q is equal to 12 and there are 12 nozzle data bits from path 178 for each primitive 50. The nozzle address on path 172 is decoded by 12 address decoders 174 which each represent one of 12 corresponding nozzles in each primitive 50. There are also 12 AND gates 176, 12 FETs 182, and 12 firing resistors 186 which each correspond to one of 12 nozzles in each primitive 50. Therefore, when the combination of the nozzle data bit, the decoded address bit, and the fire pulse provide three active inputs to a given one of 12 AND gates 176, only one of 12 firing resistors 186 is fired for each primitive 50 at a given time.

Figure 10:
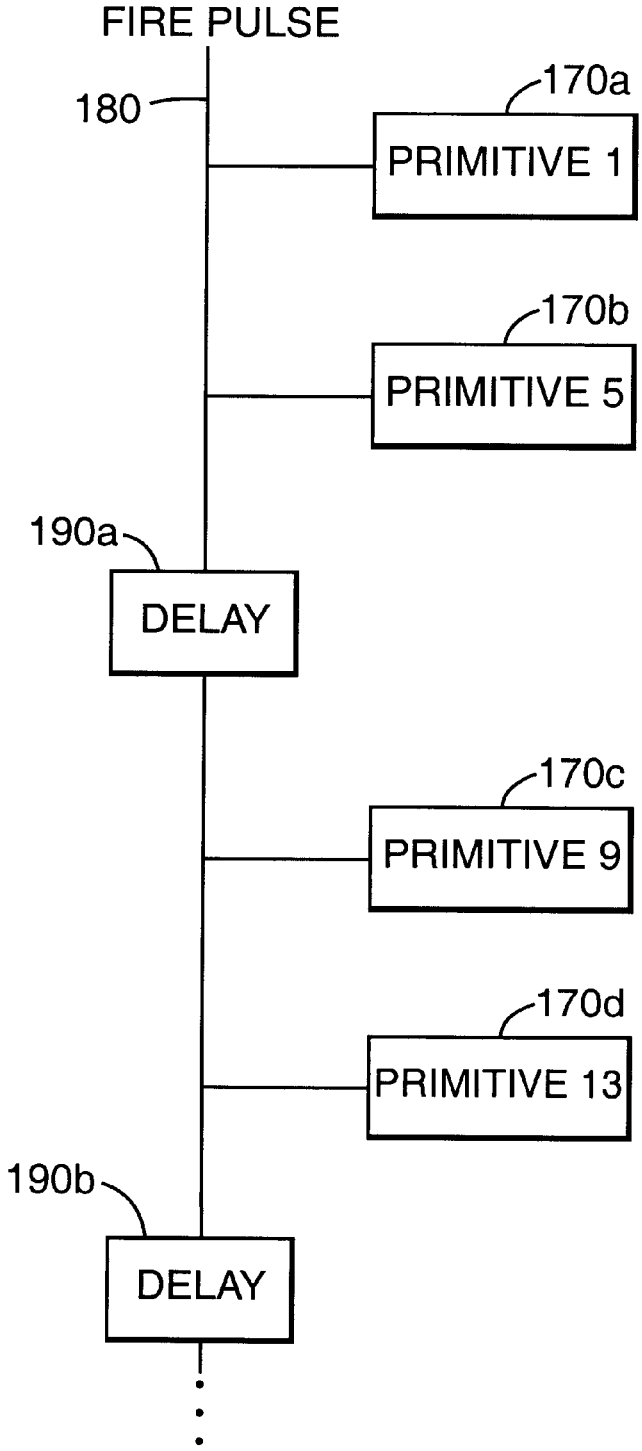
FIG. 10 is a block diagram illustrating primitives grouped into subgroups.

FIG. 10 is a block diagram illustrating primitives grouped into subgroups. In one embodiment, in each primitive column for each zone, the primitives are arranged into subgroups of primitives, wherein the fire pulse is coupled from each primitive subgroup through a delay element to another primitive subgroup until the last primitive in the column for the zone is reached. In one embodiment, the delay staggers the turn-on of the primitive subgroups in order to avoid high instantaneous switching currents while still allowing the fire pulse to be coupled to all of the firing resistors in a given zone. In various embodiments there can be any number of primitives per subgroup, depending on the level of instantaneous switching currents to be avoided.

In the example embodiment illustrated in FIG. 10, there are two primitives per subgroup and each subgroup is coupled through a delay element to another subgroup. In the example embodiment, the fire pulse on line 180 is coupled to all of the primitives in column 4 for zone 2 at 60 as illustrated in FIG. 3. The fire pulse received at line 180 is coupled to AND gates 176 in nozzle drive logic and circuitry 170*a* and 170*b*, which correspond in the example embodiment to primitive 1 and primitive 5 in zone 2 at 60 as illustrated in FIG. 3. Fire pulse 180 is next coupled through delay element 190*a* to AND gates 176 in nozzle drive logic and circuitry 170*c* and 170*d*, which correspond in the example embodiment to primitive 9 and primitive 13. Fire pulse 180 is next coupled through delay element 190*b* to subsequent AND gates 176 in nozzle drive logic and circuitry 170 until the last primitive in column 4 of zone 2 at 60 is reached, which is primitive L–3. Because at most only one firing resistor per primitive is fired at a given time, in the example embodiment, at most only two firing resistors are fired at a given time.

In another example embodiment, Q is equal to 12 for nozzle drive logic and circuitry 170 illustrated in detail in FIG. 9. Referring to FIG. 10, with two primitives per subgroup, there are a total of 24 firing resistors in each subgroup. Because only one firing resistor per primitive is fired at a given time, at most only two of the 24 firing resistors are fired in each primitive subgroup at a given time.

Although specific embodiments have been illustrated and described herein for purposes of description of the preferred embodiment, it will be appreciated by those of ordinary skill in the art that a wide variety of alternate and/or equivalent implementations calculated to achieve the same purposes may be substituted for the specific embodiments shown and described without departing from the scope of the present invention. Those with skill in the chemical, mechanical, electromechanical, electrical, and computer arts will readily appreciate that the present invention may be implemented in a very wide variety of embodiments. This application is intended to cover any adaptations or variations of the preferred embodiments discussed herein. Therefore, it is manifestly intended that this invention be limited only by the claims and the equivalents thereof.

What is claimed is:

1. A fluid ejection device comprising:

an internal power supply path configured to provide a substantially constant voltage;

nozzles;

firing resistors, wherein each firing resistor corresponds to a corresponding one of the nozzles, wherein each firing resistor and corresponding nozzle are located in one zone of a plurality of zones on the fluid ejection device, and wherein each zone has at least one firing resistor and corresponding nozzle;

addressable select logic responsive to a select address to couple multiple fire pulses to the firing resistors in the zones so that selected firing resistors in the same zone are coupled to a same fire pulse, wherein the same fire pulse controls an initiation and a duration in which the selected firing resistors in the same zone are coupled to the internal power supply path to thereby control fluid ejection from the nozzles in the same zone corresponding to the selected firing resistors; and at least two parallel and adjacent feed slots, wherein the nozzles are disposed on the fluid ejection device to be adjacent to the feed slots on either a first side or a second side of the feed slots, wherein each zone is defined to include only the nozzles in fluid communication with the adjacent feed slots.

2. The fluid ejection device of claim 1, wherein the select logic couples each fire pulse to a unique one or more zones for each value of the select address.

3. The fluid ejection device of claim 2 wherein the fluid ejection device is coupled to an electronic controller, wherein the select logic includes one or more multiplexers, and wherein the electronic controller provides the select address and the fire pulses.

4. The fluid ejection device of claim 1, wherein the zones are organized on the fluid ejection device into rows and columns, wherein if a value of the select address is a first select address, the select logic couples each fire pulse to each row so that each firing resistor in each zone in the row is coupled to the same fire pulse, and wherein if the value of the select address is a second select address, the select logic couples each fire pulse to each column so that each firing resistor in each zone in the column is coupled to the same fire pulse.

5. The fluid ejection device of claim 4 wherein the fluid ejection device is coupled to an electronic controller, wherein the select logic includes one or more multiplexers, and wherein the electronic controller provides the select address and the fire pulses.

6. The fluid ejection device of claim 1, further comprising:

feed slots, wherein each zone is defined to include only the nozzles in fluid communication with at least one feed slot, and wherein each feed slot has at least one zone.

7. The fluid ejection device of claim 6, wherein the nozzles in fluid communication with the at least one feed slot are disposed on the fluid ejection device to be adjacent to the at least one feed slot on either a first side or a second side of the at least one feed slot, wherein each zone is defined to include only the nozzles positioned on the first side, or only the nozzles positioned on the second side, and wherein either the first side or the second side has at least one zone.

8. A fluid ejection assembly, comprising:

at least one fluid ejection device, each fluid ejection device including:

an internal power supply path configured to provide a substantially constant voltage;

nozzles;

firing resistors, wherein each firing resistor corresponds to a corresponding one of the nozzles, wherein each firing resistor and corresponding nozzle are located in one zone of a plurality of zones on the fluid ejection device, wherein each zone has at least one firing resistor and corresponding nozzle;

addressable select logic responsive to a select address to couple multiple fire pulses to the firing resistors in the zones so that selected firing resistors in the same zone are coupled to a same fire pulse, wherein the same fire pulse controls an initiation and a duration in which the selected firing resistors in the same zone are coupled to the internal power supply path to thereby control fluid ejection from the nozzles in the same zone corresponding to the selected firing resistors; and at least two parallel and adjacent fluid feed slots, wherein the nozzles are disposed on the fluid ejection device to be adjacent to the fluid feed slots on either a first side or a second side of the fluid feed slots, wherein each zone is defined to include only the nozzles in fluid communication with the adjacent fluid feed slots.

9. The fluid ejection assembly of claim 8, wherein the select logic couples each fire pulse to a unique one or more zones for each value of the select address.

10. The fluid ejection assembly of claim 8, wherein the zones are organized on the fluid ejection device into rows and columns, wherein if a value of the select address is a first select address, the select logic couples each fire pulse to each row so that each firing resistor in each zone in the row is coupled to the same fire pulse, and wherein if the value of the select address is a second select address, the select logic couples each fire pulse to each column so that each firing resistor in each zone in the column is coupled to the same fire pulse.

11. The fluid ejection assembly of claim 8, further comprising:

fluid feed slots, wherein each zone is defined to include only the nozzles in fluid communication with at least one fluid feed slot, and wherein each fluid feed slot has at least one zone.

12. The fluid ejection assembly of claim 11, wherein the nozzles in fluid communication with the at least one fluid feed slot are disposed on the fluid ejection device to be adjacent to the at least one fluid feed slot on either a first side or a second side of the at least one fluid feed slot, wherein each zone is defined to include only the nozzles positioned on the first side, or only the nozzles positioned on the second side, and wherein either the first side or the second side has at least one zone.

13. A method of firing a fluid ejection device, the method comprising:

providing a substantially constant voltage on an internal power supply path in the fluid ejection device;

providing a select address;

coupling, based on the select address, multiple fire pulses to firing resistors located in zones so that selected firing resistors in the same zone are coupled to a same fire pulse, wherein each firing resistor corresponds to one of a plurality of nozzles, wherein each firing resistor and corresponding nozzle are located in one of the zones, and wherein each zone has at least one firing resistor and corresponding nozzle;

controlling, with the same fire pulse, an initiation and a duration in which the selected firing resistors in the same zone are coupled to the internal substantially constant voltage to thereby control fluid ejection from the nozzles in the same zone corresponding to the selected firing resistors; and providing at least two parallel fluid feed slots, wherein the nozzles are disposed on the fluid ejection device to be adjacent to the fluid feed slots on either a first side or a second side of the fluid feed slots, wherein each zone is defined to include only the nozzles in fluid communication with the adjacent fluid feed slots.

14. The method of claim 13 further comprising:

coupling each fire pulse to a unique one or more zones for each value of the select address.

15. The method of claim 13 further comprising:

organizing the zones on the fluid ejection device into rows and columns;

coupling each fire pulse to each row so that each firing resistor in each zone in the row is coupled to the same fire pulse if the value of the select address is a first select address; and coupling each fire pulse to each column so that each firing resistor in each zone in the column is coupled to the same fire pulse if the value of the select address is a second select address.

16. The method of claim 13 further comprising:

providing fluid feed slots wherein each zone for each fluid feed slot is defined to include only the nozzles in fluid communication with at least one fluid feed slot, wherein each fluid feed slot has at least one zone.

17. The method of claim 16 further comprising:

defining each zone to include only the nozzles positioned to be adjacent to the at least one fluid feed slot on either a first side or a second side, wherein either the first side or the second side has at least one zone.

* * * * *

UNITED STATES PATENT AND TRADEMARK OFFICE

CERTIFICATE OF CORRECTION

PATENT NO. : 6,726,300 B2
DATED : April 27, 2004
INVENTOR(S) : Schloeman et al.

It is certified that error appears in the above-identified patent and that said Letters Patent is hereby corrected as shown below:

Title page,
Item [56], References Cited, U.S. PATENT DOCUMENTS, add
-- 6,312,079 11/2001 Anderson et al. --
FOREIGN PATENT DOCUMENTS, add
-- EP0592221A1 4/1994
EP0674993A2 10/1995 --.

Signed and Sealed this

Twenty-ninth Day of June, 2004

JON W. DUDAS
*Acting Director of the United States Patent and Trademark Office*